US008016701B2

(12) United States Patent
Lamson et al.

(10) Patent No.: US 8,016,701 B2
(45) Date of Patent: Sep. 13, 2011

(54) LACROSSE HEAD

(75) Inventors: Kyle L. Lamson, Chelmsford, MA (US); Adam D. Paquette, Leominster, MA (US)

(73) Assignee: Warrior Sports, Inc., Warren, MI (US)

( * ) Notice: Subject to any disclaimer, the term of this patent is extended or adjusted under 35 U.S.C. 154(b) by 268 days.

(21) Appl. No.: 12/410,897

(22) Filed: Mar. 25, 2009

(65) Prior Publication Data

US 2010/0248869 A1 Sep. 30, 2010

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/505, 512; D21/724
See application file for complete search history.

(56) References Cited

U.S. PATENT DOCUMENTS

| | | | | |
|---|---|---|---|---|
| 1,508,286 | A * | 9/1924 | Moore | 473/546 |
| 2,142,527 | A | 1/1939 | Pool | |
| 5,568,925 | A * | 10/1996 | Morrow et al. | 473/513 |
| 5,957,791 | A * | 9/1999 | Nichols et al. | 473/513 |
| 6,916,259 | B2 | 7/2005 | Kohler et al. | |
| 6,929,572 | B2 | 8/2005 | Morrow et al. | |
| 7,104,904 | B1 | 9/2006 | Gait | |
| 7,131,919 | B2 * | 11/2006 | Kohler et al. | 473/513 |
| 2002/0173389 | A1 * | 11/2002 | Morrow | 473/513 |
| 2004/0002398 | A1 * | 1/2004 | Morrow et al. | 473/513 |
| 2008/0026884 | A1 * | 1/2008 | Morrow et al. | 473/513 |
| 2008/0293524 | A1 | 11/2008 | Gait | |

OTHER PUBLICATIONS

STX Hype, download from http://www.e-lacrosse.com/2002/hype on Mar. 3, 2009, 22 pp.

* cited by examiner

*Primary Examiner* — Gene Kim
*Assistant Examiner* — M Chambers
(74) *Attorney, Agent, or Firm* — Warner Norcross & Judd LLP

(57) ABSTRACT

A lacrosse head includes sidewalls having an open frame construction. The sidewalls include an upper rail and a lower rail, along with a cross member joined with the upper rail and the lower rail. The cross member defines multiple holes corresponding to multiple pocket configurations so that a user can attach a lacrosse net to selected ones of the holes and achieve a desired pocket profile. Optionally, at least one of the upper and lower rails can be void of any string holes. Further optionally, the cross member can branch into one or more secondary members that also define string holes to provide additional pocket profiles. Even further optionally, the holes defined by the cross member can be of polygonal shape.

25 Claims, 6 Drawing Sheets

LACROSSE HEAD

BACKGROUND OF THE INVENTION

The present invention generally relates to a lacrosse head for attachment to a lacrosse handle, and more particularly to a lacrosse head including holes defined in the structure of the sidewalls of the head adapted to accommodate pocket strings.

Conventional lacrosse heads typically include an open frame having a ball stop joined with the base, a pair of sidewalls that diverge from the ball stop, and a scoop that connects the sidewalls, opposite the ball stop. The sidewalls generally include a lower portion, such as a lower rim, that defines multiple circular or elliptical string holes. A lacrosse net is strung to the lower rim via the string holes, around the back side of the frame, leaving the opposing side of the frame open for catching or shooting a lacrosse ball.

Many heads also are configured so that the netting hangs downward from the lowermost portion of the frame, having minimal to no contact with the sidewalls—other than where the net is attached to the lower rim of the sidewalls. While this construction frequently provides the desired amount of ball retention, it limits the configurations by which a player can string a net to the head and achieve a particular catching or shooting feel.

A modification to this limited, lower rim stringing configuration is shown in U.S. Pat. No. 5,957,791 to Nichols. There, instead of the lower rim of the head defining string holes, the upper rim of the sidewall, along with the transition region from the sidewall to the scoop, defines the string holes. With this configuration, a portion of the net can be positioned between the sidewalls of the head, so that the ball remains relatively high between the sidewalls. Such a configuration can be desired out of personal player preference, or to comply with certain lacrosse rules, such as the present NCAA Women's Lacrosse Rules, which require that the top of a lacrosse ball remains above the sidewalls when the ball is in the net. This top rim stringing configuration, however, goes to the other extreme by placing the net quite high in the head. Nichols also offers yet another construction where string holes are defined generally in the upper half of a solid sidewall. While altering the location where the net is strung to the wall, this construction still provides somewhat limited options to a player because the net is confined to a single predetermined location dictated by the manufacturer's placement of the string holes.

SUMMARY OF THE INVENTION

The present invention provides a lacrosse head that enables a player to string a net to the head in a variety of configurations.

In one embodiment, the head includes sidewalls having an open frame construction. The sidewalls can include an upper rail, a lower rail and a cross member joined with the upper rail and the lower rail. The cross member can define multiple holes corresponding to multiple pocket configurations so that a user can attach a lacrosse net, and more particularly, its attachment strings, to selected ones of the holes and achieve a desired pocket profile.

In another embodiment, the upper and lower rails can be void of any string holes. Optionally, only the lower rail, or only the upper rail, can be void of string holes.

In still another embodiment, the holes of the cross member can extend laterally inward from an exterior surface toward an interior surface of the sidewall. Optionally, the holes can be configured so that they are void of any vertical portion that extends upward or downward relative to the sidewall. Further optionally, the holes can be configured so that strings strung through them project directly and in an unprotected manner into the interior region of the head.

In yet another embodiment, the cross member can diverge into one or more secondary members. These secondary members can optionally also define string holes to provide additional pocket profiles.

In a further embodiment, the cross member can define multiple first holes and multiple second holes. The first holes can be aligned along a first contour, while the second holes can be aligned along a second contour of the cross member. By attaching a lacrosse net to selected ones of the first holes and the second holes in a desired combination, a user can provide the lacrosse net with a desired pocket profile.

In yet a further embodiment, the head can include an upper rail and a lower rail that join the scoop at a scoop junction. In addition to the cross member holes, the scoop junction can define at least one string hole.

In another, further embodiment, the holes in the cross member can be adapted to receive strings of the lacrosse net so that when a lacrosse ball is placed in the net, at least a portion of the lacrosse ball protrudes above an uppermost part of the upper rail. By providing this ball carrying characteristic, the head optionally can comply with the present NCAA Women's Lacrosse Rules, which require this ball positioning.

In yet another further embodiment, the cross member can generally be in the form of an X or Y, with certain ends of the cross member joined with the upper rail, lower rail, scoop and/or base. The upper portion of the X or Y can define holes following a high contour, while the lower portion of the X or Y can define holes following a low contour. The high and low contours can correspond to desired pocket configurations that hold a lacrosse ball in a net joined with the at desired heights within the head.

The lacrosse head of the present invention provides a simple and efficient construction that enables users to string the lacrosse head with the lacrosse net at the bottom, middle, top or any point in between, depending on the desired characteristics of the net or the pocket profile. This provides users with a highly customized pocket, and thus enables them to play at a much higher confidence and efficiency levels. Further, where the net attachment points are raised above the lower rail of the sidewall, a deeper NCAA Rule compliant pocket can be effectively formed, providing the player with better ball feel and hold. Finally, where the upper and lower rails are void of conventional string holes, or simply have a reduced number of conventional string holes, the strength of the sidewalls can be increased, as such conventional string holes can often weaken these structures.

These and other objects, advantages, and features of the invention will be more fully understood and appreciated by reference to the description of the current embodiment and the drawings.

DESCRIPTION OF THE CURRENT EMBODIMENT

Figure 1:
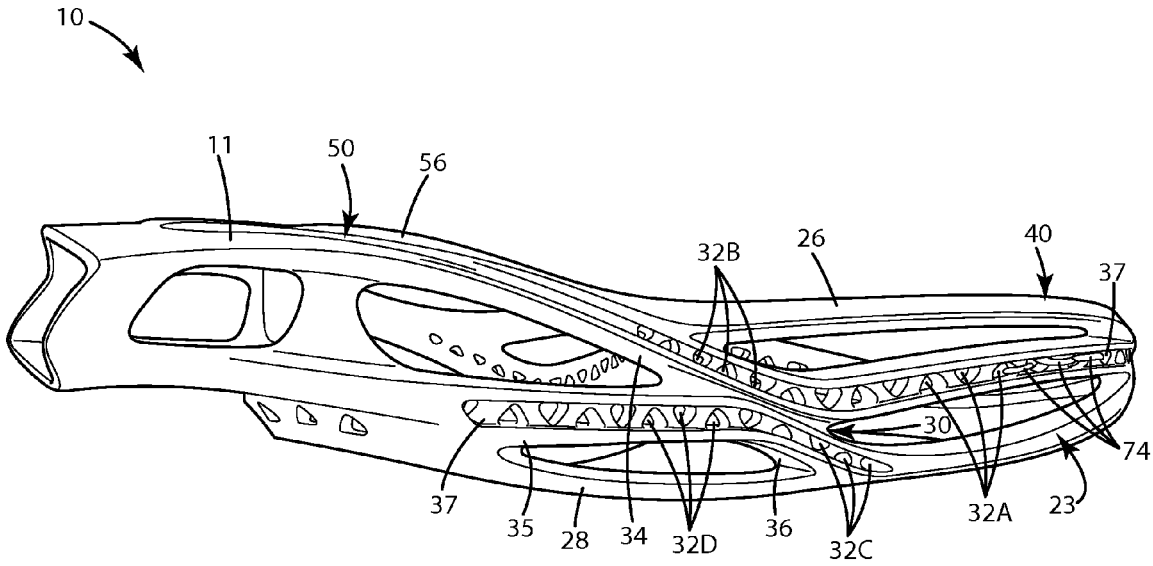
FIG. 1 is a rear perspective view of a current embodiment of a lacrosse head in accordance with the present invention.

A current embodiment of the lacrosse head of the present invention is shown in FIGS. 1-5 and generally designated 10. The lacrosse head 10 includes a throat 11 adapted to connect to a lacrosse handle 12, a pair of opposing sidewalls 20 and a scoop 40 connecting the pair of opposing sidewalls 20 opposite the throat 11. Located at the lower end of the head, adjacent the throat 11, is a base 50 which includes a ball stop 52. The sidewalls 20 can sidewall be of an open frame construction, that is, they can define at least one non-string hole that is adapted to reduce the weight of the head, such as the frame hole 21. Each sidewall can also include an upper rail 26 and a lower rail 28 separated from one another by a distance. A cross member 30 can be joined with the upper rail and the lower rail. The cross member 30 can define multiple holes 32A-D that can both serve to reduce weight of the head and provide locations where attachment strings from a lacrosse net can be joined. Each of the above structures will now be described in further detail.

Figure 2:
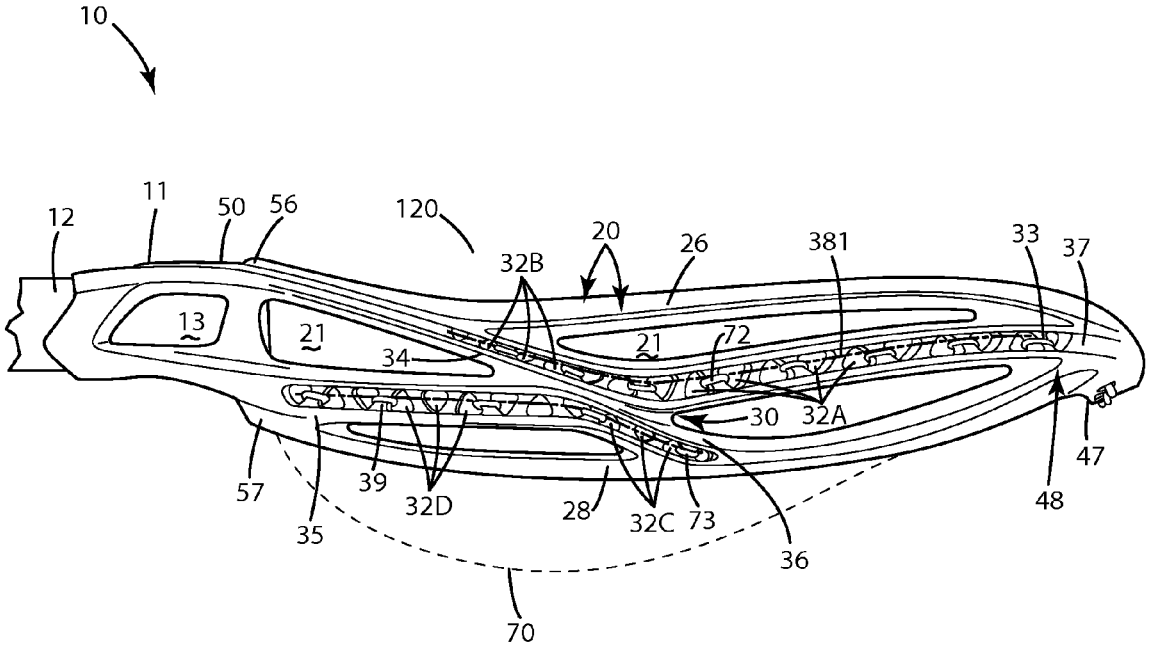
FIG. 2 is a side view of the lacrosse head.

As depicted in FIG. 2, the throat 11 can extend from the base 50, and can define a socket 13. The socket 13 can be tubular in shape and can define a cavity to receive a handle 12. Alternatively, the throat 11 can include a projection which is adapted to fit within a handle. The handle 12 can be secured within the socket 13, optionally by a fastener (not shown), such as a screw, peg, or other fastening devices or materials such as adhesives. Optionally, the socket 13 can define apertures or holes (not shown) to reduce the weight of the head.

Figure 3:
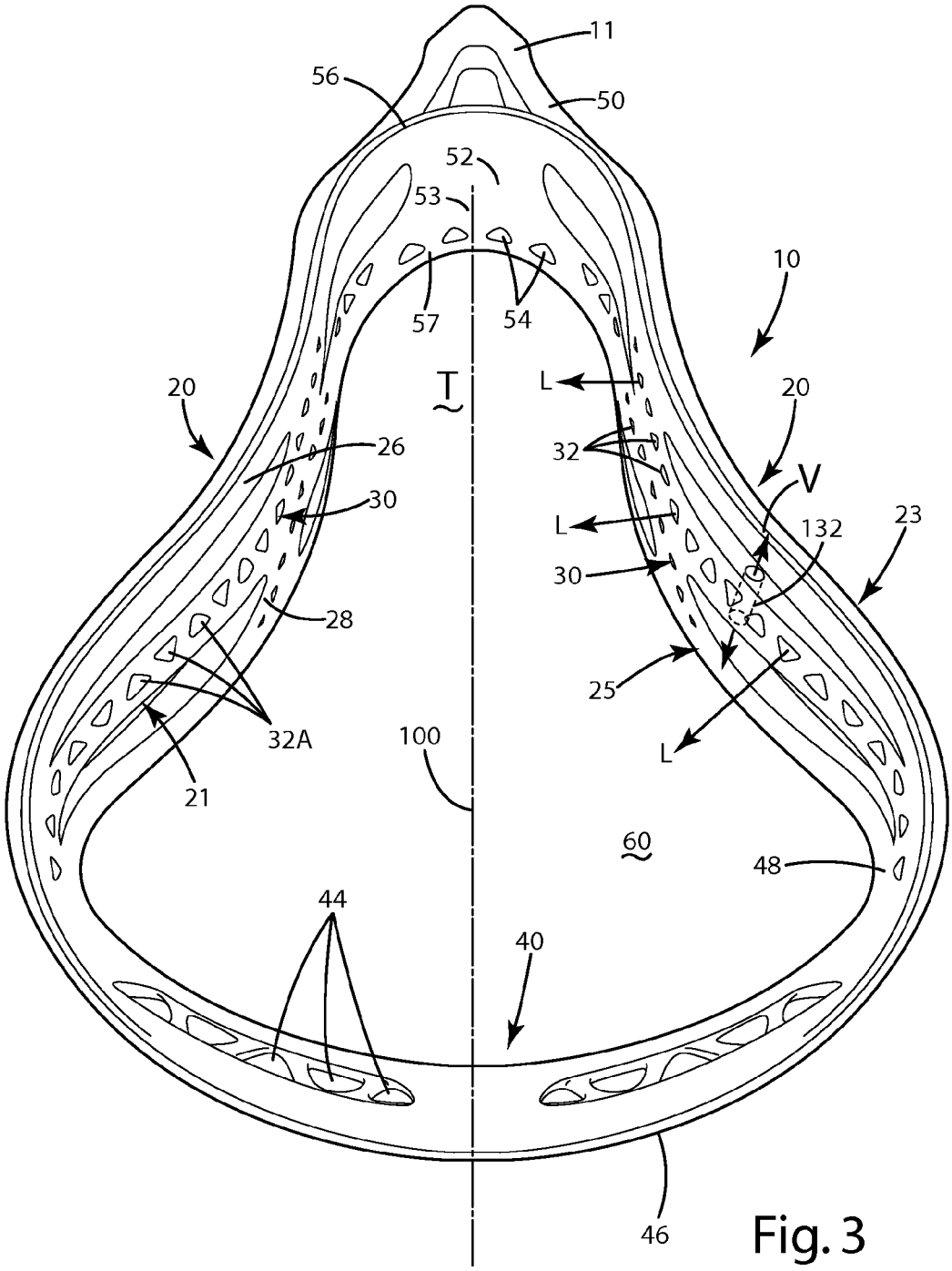
FIG. 3 is front view of the lacrosse head.

As shown in FIG. 3, the head 10 can include a pair of sidewalls 20. These sidewalls can be positioned on opposite sides of a longitudinal axis 100 of the head, which can generally bisect the head in opposing halves. The longitudinal axis 100 can pass directly through the middle portion 53 of the ball stop 52 as described in further detail below. One or both of the sidewalls 20 can extend generally from the ball stop 52 toward the scoop 40, which is located at the opposite end of the head 10.

Each sidewall can include upper rims 26 and lower rims 28. These rims can be secured to and extend between the base 50 and the scoop 40. Alternatively, these upper and lower rims can be an extension of the base 50. Referring to FIG. 3, the upper rims 26 can follow an outward curvilinear path near the base 50 before extending generally parallel to the central longitudinal axis 100 along a portion of its length, generally within the throat T of the head. The throat T can generally extend from the ball stop 50 to ½ to ⅔ the length of the ball receiving area 60 of the head. Optionally, the upper and lower rims can be of a circular, polygonal, elliptical, rectangular, or beveled cross-sections that are generally uniform or vary as these elements extend from the base 52 to the scoop 40.

Figure 4:
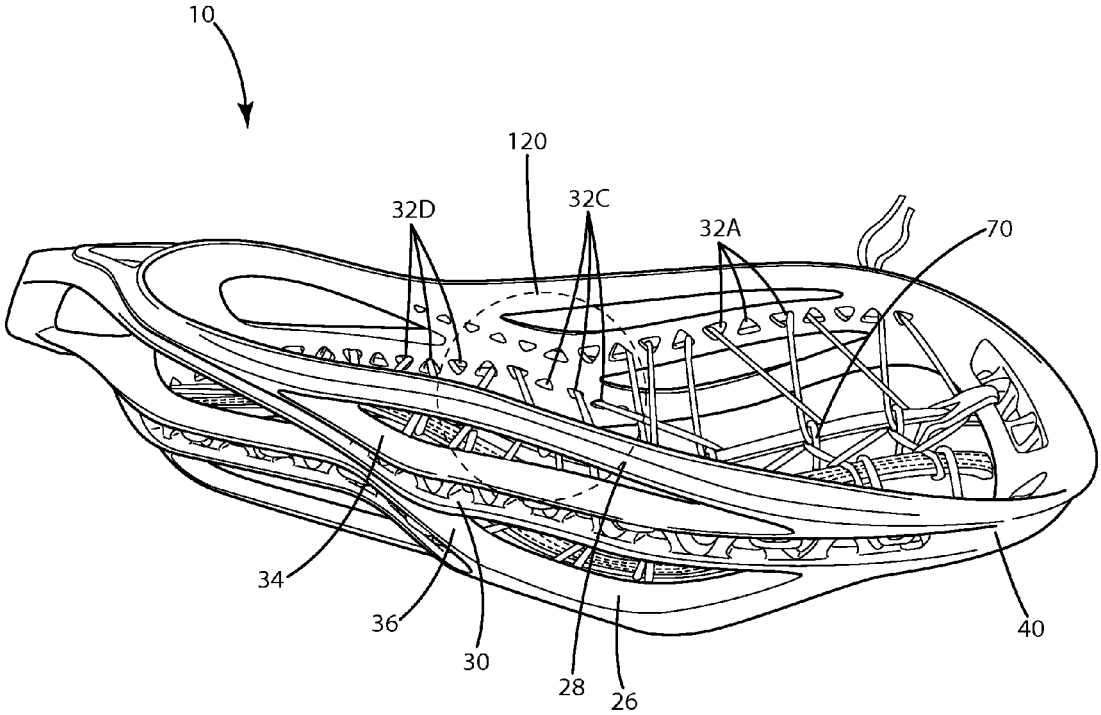
FIG. 4 is a side perspective view of the lacrosse head strung in accordance with one selected string configuration.

As shown in FIGS. 1-2, the sidewalls can be of an open frame construction, wherein those sidewalls define one or more non-string apertures 21 between the upper and lower rims. These apertures can be of any preselected shape, and can be configured for structural or aesthetic purposes as desired. In addition to the non-string holes, the sidewalls and other portions of the head optionally can include multiple string holes, such as the ball stop holes 54, and the scoop holes 44 that allow attachment of net 70 to the head 10 (FIG. 4). The precise placement of these string holes can vary as desired.

As shown in FIGS. 1-3, the upper and lower rims 26 and 28 optionally can be void of any string holes. Alternatively, only one of the upper and lower rims can be void of any string holes as desired.

The sidewalls 20, and particularly the upper rims 26 can join with an upper rim 56 of the ball stop 50, as well as an upper rim 46 of the scoop 40. This bounded region can generally define a ball receiving area 60, which is where a lacrosse ball can enter or exit the head 10 when the ball 120 is caught, thrown, shot or dislodged. Opposite the ball receiving area, the sidewall lower rim 28, scoop lower rim 47 and ball stop lower rim 57 can also define a lower bounded region, which can define a ball retaining area. This is where a lacrosse ball 120 typically is located when retained in the head 10 and more particularly in the net 70 attached to the head 10.

Referring to FIGS. 1-3, the sidewalls 20 of the lacrosse head 10 can include a cross member 30 which defines a plurality of holes 32, which are referred to herein generally as holes, as cross member holes and string holes. These holes are adapted to receive the strings of a lacrosse net 70 so that a user can attach the net to the head to form a pocket. Given the variety of different holes 32A-D available, a user can string the head to any number of preselected ones of the holes to provide a desired net configuration which will be explained in further detail below with reference to FIGS. 4 and 5.

The cross member generally extends between and is joined with the upper rail 26 and lower rail 28. As shown in FIGS. 2 and 4, the cross member 30 can join the upper rail 26 near the scoop. More particularly, the cross member can include a first end 33 which joins the upper rail 26 and lower rail 28, as well as the scoop 40, at a scoop junction 48. Of course, the cross member can join the upper rail farther rearward from the scoop to the upper rail or lower rail as desired.

A cross member can also include a second end 35 which can be joined with the lower rail 28 and the lower rim 57 of the base. Optionally, this second end can be located anywhere along the lower rail and joined with the upper rail and/or the lower rail at any location along the lengths of those components as desired. In extending away from the scoop 40 toward the base 50, the cross member can follow a generally downwardly angling or curving path and include varying curvatures or angled portions. Optionally, the cross member can upwardly angle or curve or follow a variety of different contours as desired.

As shown in FIG. 2, the cross member can include a first secondary member 34 branches from the cross member as it translates rearwardly toward the base 50. This first secondary member can extend upwardly at a curvilinear or linear fashion away from the main body of the cross member toward the upper rail. As desired, the first secondary member can be joined directly with the upper rail 26 at a variety of locations along the upper rim 26. As shown, the first secondary member 34 is joined with the upper rim generally within the throat T of the head, however, as desired, this location may vary.

The first secondary member 34 can also define its own holes 32B adapted to receive the strings of the lacrosse net. As illustrated, in FIG. 2, those string holes 32B can be positioned in a location generally above the holes 32D of the cross member 30. Given the different locations, the user can attach the net to either the holes 32B or 32D or combinations of those holes to provide a desired pocket profile of the net. For example, if the user wants to have the ball suspended higher in the net and between the sidewalls, the user may select the string holes 32B which are positioned a farther distance from the lower rim 28 than the holes 32D.

With further reference to FIG. 2, the cross member 30 can also include a second secondary member 36 which extends downwardly, away from the main body of the cross member 30. The secondary member can extend in a curvilinear or linear manner toward the lower rail 28, and again can be joined with that lower rail. As desired, however, this secondary member 36 can extend toward any other element of the head and be joined with that element as desired. Of course, this branching member can be altogether absent from the head, as can be the first secondary member 34 described above.

The second secondary member 36 can also define one or more holes 32C adapted to accommodate the strings of a net 70 attached to the head 10. As perhaps best shown in FIG. 2, those holes 32C can be downwardly displaced relative to the holes 32A of the cross member 30. With the wide variety of holes, namely 32A and 32C, a user can string the lacrosse net 70 to selected ones of those holes. For example, a user can string a portion of the net at the location 72 or the location 73. The location 72 (assuming the strings attached to the net 70 are the same length) would hold the net higher in the head 10, and particularly between the sidewalls so that the resulting pocket formed by the net is formed at least partially between the sidewalls 20. By varying the location from 72 to 73 or any other combination of holes, a user can string the lacrosse net with a desired pocket profile.

Although not shown, the cross member 30 can include multiple additional secondary members extending from it and connected to other components of the lacrosse head 10 as desired. Moreover, the secondary members can be less well defined than that illustrated in FIG. 2. For example, the secondary members could be regions of the cross member 30 that jut upward or downward toward the upper or lower rims as desired, optionally forming connections between the cross member and those elements or other elements of the head 10.

The holes 32A-D can be arranged along the cross member in a variety of configurations. As shown in FIG. 2, the holes 32A and 32B can follow a first contour 38, while the holes 32C and 32D can follow a second contour 39 which is distinct from the contour 38. These contours can be linear, curvilinear or any combination of such geometric configurations. Optionally, the contours 38 and 39, along which the different holes are defined overlap one another within the sidewall, and optionally, within the cross member to provide different stringing configurations for the net 70. Contours 38 and 39 can be separate and distinct from one another and overlap one another generally in the throat T of the head. This overlap can occur in different regions of the head 10, and indeed can occur along the entire length of the head from scoop 40 to base 50 as desired.

With the holes aligned on different contours, a user can string the net 70 to selected ones of those holes and fully or partially follow the contours associated with which those holes are associated to provide a desired pocket profile. Optionally, the contours which the holes 32A-D follow can be parallel to one another in certain regions, however, in other regions, the contours can be at least partially transverse to one another. While the holes of the cross member can follow particular contours as desired, it should also be appreciated that the holes can be defined randomly in the cross member, without being specifically aligned with other groups of holes. Alternatively, the cross member can define multiple holes in a particular, consistently spaced pattern depending.

Referring to FIGS. 1-3, the holes 32 can be of a polygonal shape, such as in the form of a rounded corner triangle. Other polygonal configurations for the holes can be selected as desired, such as square, trapezoidal, octagonal and random shapes. Optionally, whatever the shape selected, the corners can be rounded to prevent abrasion of the strings joined with the holes. Of course, the holes can also be entirely rounded in the shape of a circle or ellipse as desired.

The holes 32 can also be configured to rest within a groove 37 as desired, or shown in FIG. 2. In this configuration, a net string 72 that is strung to the holes as shown in FIGS. 2 and 3 can be generally protected from abrasion when the exterior surface of the sidewall 23 contacts an abrasive surface. The interior surface 25 of the sidewalls as shown in FIG. 3, can be generally flat and grooveless near the holes 32 because as abrasion caused by contact with other surfaces is not quite as frequent an issue there as with the exterior surface 23 of the of the sidewall and/or head.

As illustrated in FIGS. 2 and 3, the configuration of the holes 32 can also be selected to promote easy connection to the net 70. For example, as shown in FIG. 3, the holes can extend from an exterior surface 23 of the sidewall 20 to an interior surface 25 of the sidewall generally toward the longitudinal axis 100. Particularly, the holes 32 can extend generally laterally in the general directions L as indicated in FIG. 3. By extending in this direction L, the holes can provide relative ease of attachment of the net via strings to the sidewalls 20. As desired, certain holes 132 can additionally or alternatively be defined by the cross member 30. Those holes 132 can be aligned generally vertically in the direction V as illustrated in FIG. 3. Various optional combinations of lateral and vertical direction orientation can be selected for the holes.

Figure 5:
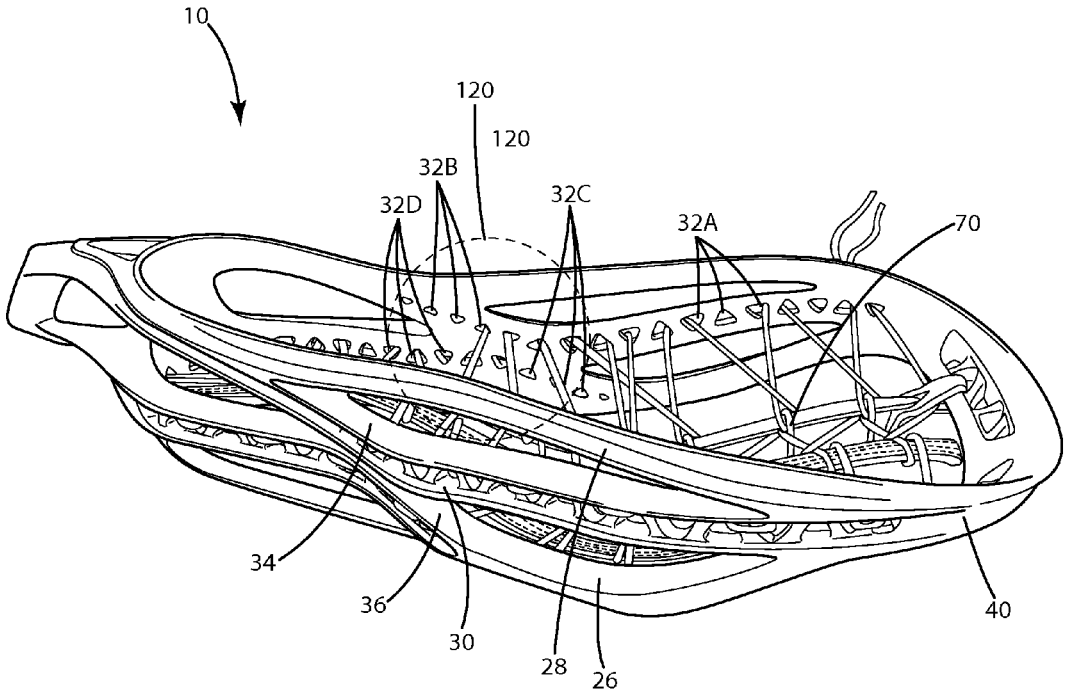
FIG. 5 is a side perspective view of the lacrosse head strung in accordance with another selected string configuration.

FIGS. 4 and 5 illustrate different exemplary string configurations of a net 70 within a head. As shown in FIG. 4, the middle portion of the net 70 is generally strung to the string holes 32C near the base 50 and the string holes 32A near the scoop. Between those regions, however, the net 70 is strung to the string holes 32C. As shown, the lacrosse ball 120 is at a higher position in the head relative to the sidewalls 20. As illustrated in FIG. 5, the net 70 is generally strung to the holes 32D near the base and 32A near the scoop, however, in the middle region, the net is strung to the higher holes 32B. As a result, the ball 120 sits within the pocket profile higher than the ball sits in the pocket of FIG. 4. Any variety of combinations of stringing to different holes 32A-D can be selected by the user to alter the way the ball 120 sits in the net 70 as well as the pocket profile of the net.

A first alternative embodiment of the lacrosse head will now be described with reference to FIG. 6. There, the head 210 includes a base 150 and a scoop 140 opposite the base. Sidewalls 120 can extend from the scoop to the base, joining those components. The sidewalls can include generally open frame holes 121, as well as holes 132A and 132B. These holes 132A and 132B can be configured to receive strings to attach a net to the sidewalls 120. Generally, these holes 132A and 132B can be defined in a central or side region 130 of the sidewall that lies between the upper rail 126 and the lower rail 128. With these holes 132A, 132B defined in the side region 130, the upper and lower rails can be void of string holes as desired. The particular configuration and size of the holes 132A and 132B can vary as desired. As shown, the holes 132A are generally larger than the lower holes 132B. Of course, this arrangement can be reversed. Moreover, although shown as polygonal shapes, more particularly, triangular shapes, the holes can be of any polygonal shape or can be circular, elliptical or otherwise rounded.

Figure 6:
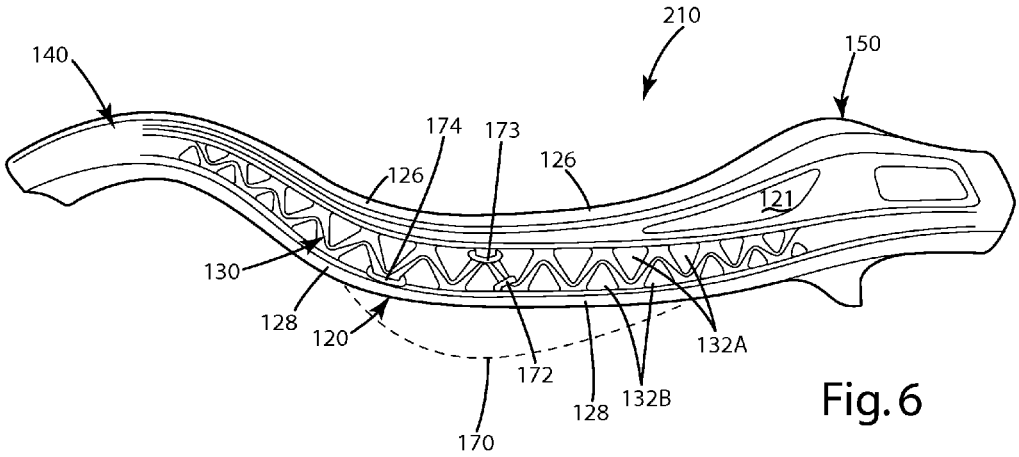
FIG. 6 is a side view of a first alternative embodiment of the lacrosse head.

As illustrated in FIG. 6, the net strings 172, 173 and 174 can be joined with the side region 130 in a variety of configurations at a variety of heights along the sidewall 120. For example, with the net 170 strung via the string 173, the portion of the net can be held higher than when the net is strung with a string 172 or 174 in that same region. Varying combinations of strings in preselected ones of the holes 132A and 132B can provide desired pocket configuration suitable to the user's preferences.

Figure 7:
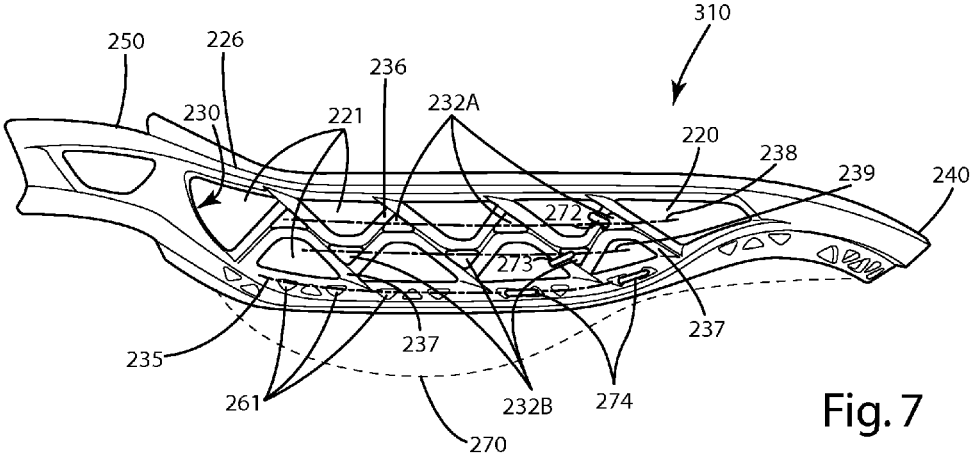
FIG. 7 is side view of a second alternative embodiment of the lacrosse head.

A second alternative embodiment of the lacrosse head will now be described with reference to FIG. 7. There, the head 310 includes a base 250 and a scoop 240 opposite and connected to the base by sidewalls 220. The sidewalls can include generally open primary holes 221, as well as holes 232A and 232B. These holes 232A and 232B can be configured to receive strings to attach a net 270 to the sidewalls 220. Generally, all of the open frame holes 221, 232A and 232B are defined by a cross member 230 that extends from just forward of the base 250 to just short of the scoop 240. Optionally, the cross member can include multiple upward and downwardly projecting secondary members 236 and 237. Each of these secondary members 236 and 237 can independently define holes 232A and 232B which are adapted to receive strings of a net 270. These holes 232A and 232B can be of any geometric shape, however, as shown, they can be generally polygonal, and specifically triangular in shape. Moreover, the secondary members can be duplicated in number along the cross member 230 to provide as many different configurations for stringing a net 270 as desired.

The holes themselves 232A and 232B can generally be aligned on first 238 and second 239 contours respectively. These contours can be aligned in parallel as illustrated, however, they can be at angles or curved relative to one another as desired. In addition to the cross member 230 including holes, the lower rim 228 and/or upper rim 226 can include additional string holes 261 to provide even further stringing configurations. The string holes 261 on the lower rim can be placed on yet a third contour 235 which is downwardly displaced from the first 238 and second 239 contours a preselected distance as desired.

The net strings 272, 273 and 274 can be joined with the side region 230 in a variety of configurations at a variety of heights along the sidewall 220. For example, a string net 272 can be strung through a string 232A on the first contour 238, around a portion of a secondary member and through an open frame hole 221. In another string configuration, a string 273 can be strung through a string hole 232B on the second contour 239 around a portion of the secondary member and through an open hole 221. In yet another string configuration, strings 274 join with a net 270 can be strung through dedicated string holes 261 in the lower rim 228. Depending on the location and relevant holes through which the net strings are strung, a player can adjust the pocket to a desired depth in different regions of the head depending on the players desired head functionality.

A third alternative embodiment of the lacrosse head will now be described with reference to FIG. 8. In that embodiment, the head 410 includes a base 350 and a scoop 340 opposite and connected to the base by sidewalls 320. These sidewalls include generally open primary holes 321, as well as secondary holes 332A and 332B. Any of the holes 321, 332A and 332B can be configured to receive strings to attach a net 370 to the various portions of the cross member 330 which extends generally from the base toward the scoop.

The cross member 330 can include multiple X-shaped members 352. These X-shaped members can include tops 355 and bottoms 357 which are respectively joined with the upper rail 326 and the lower rail 328. The X-shaped members 352 can be part of and collectively form cross member 330 extending from the base to the scoop. In generally, this configuration forms a cross member that is referred to herein as an X-cross member construction. Although shown with tops and bottom members of the X-shaped members 352 connected, there may be spaces between respective tops and bottoms of the X-shaped members.

Figure 8:
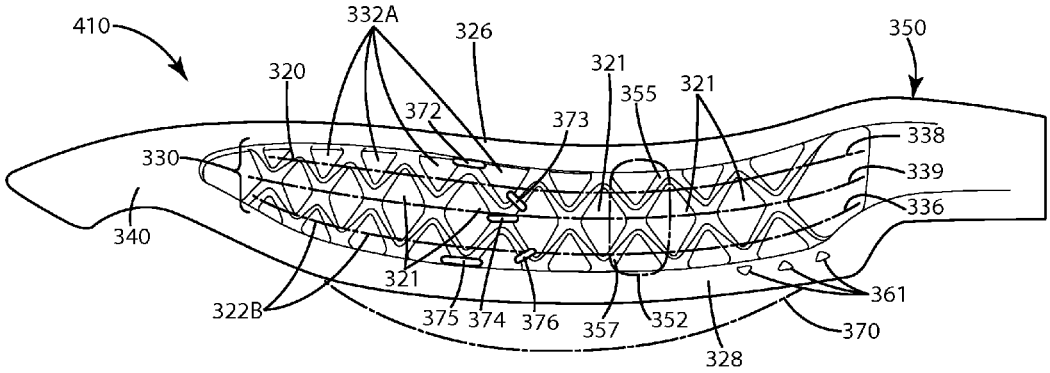
FIG. 8 is a side view of a third alternative embodiment of the lacrosse head.

Referring to FIG. 8, the holes 321, 332A and 332B can be generally aligned along contours 336, 338 and 339, respectively. These contours can be aligned in parallel as illustrated. However, they can be at angles or curved relative to one another as desired as well. As desired, the lower rail 328 can define dedicated string holes 361 to provide additional stringing configurations for the net 370. These string holes 361 can be configured along yet another contour which is downwardly displaced from the other contours 336, 338 and 339. As shown, the contour 339 is downwardly spaced from 338, and the contour 336 is downwardly displaced from the contour 339. Of course, where the contours are of varying configurations, the order from top to bottom of the first, second and third contours can also vary.

The net strings 372, 373, 374, 375 and 376 can be joined with the cross member 330 in a variety of configurations for a variety of heights along the sidewall 320. As an example, the string 372 can be strung through adjacent string holes 332A, another string 374 can be strung along contour 339 through string holes 321. Yet other strings 373 can be strung through both string holes 332A and 321. Depending on the location and relevant holes through which the net strings are strung, a player can adjust the pocket to a desired depth in different regions of the head depending on the player's desired head functionality.

As with all the embodiments above, the head can be of a closed frame construction, or an open frame, monolithic construction and formed from one or more of a variety of compounds such as nylon, urethane, polycarbonate, polyethylene, polypropylene, polyketone or polybutylene terephalate. The head can be formed by first selecting its shape and configuration. After the shape and configuration is selected, a mold having a mold cavity can be formed in the shape of the head to be formed.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lacrosse head comprising:

a throat adapted to connect to a lacrosse handle;

a base joined with the throat, the base including a ball stop;

a scoop distal from the base; and a first sidewall and a second sidewall, each extending from the base toward the scoop and joined with one another distal from the base at the scoop, each first and second sidewall being of an open frame construction and defining at least one non-string hole, each first and second sidewall including an upper rail and a lower rail, and at least one cross member extending between and joined with the upper rail and the lower rail, wherein both of the upper rail and lower rail of both of the first and second sidewalls are substantially void of any string holes, wherein the cross member branches into a first secondary member and a second secondary member, wherein each of the cross member, the first secondary member and the secondary members each define a plurality of string holes adapted to receive strings of a lacrosse net so that a user can attach the lacrosse net to the head to form a pocket that is at least partially suspended and located between the first and second sidewalls, whereby a user can string the lacrosse net to at least one of the cross member, the first secondary member and the second secondary member so that the lacrosse net can have a variety of different net configurations and wherein the upper rail and lower rail join the scoop at a scoop junction, wherein a string hole is defined in the scoop junction and wherein the cross member joins the upper rail and lower rail and the scoop at the scoop junction.

2. The lacrosse head of claim 1 wherein the first secondary member extends upwardly, away from the cross member, toward the upper rail to which the first secondary member is also joined.

3. The lacrosse head of claim 2 wherein the second secondary member extends downwardly, away from the cross member, toward the lower rail to which the second secondary member is also joined.

4. The lacrosse head of claim 1 wherein plurality of string holes in the cross member are adapted to receive strings of the lacrosse net so that when a lacrosse ball is placed in the net, at least a portion of the lacrosse ball protrudes above an uppermost part of the upper rail.

5. The lacrosse head of claim 1 wherein the cross member includes a first end and a second end, and extends away from the scoop toward the base along a generally downwardly angling path, the first end being joined with the upper rail near the scoop, the second end being joined with the lower rail near the base.

6. A lacrosse head comprising:

a throat adapted to connect to a lacrosse handle;

a base joined with the throat;

a scoop distal from the base; and a pair of sidewalls extending from the base and joined with one another distal from the base at the scoop, each sidewall being of an open frame construction, each sidewall including an upper rail and a lower rail separated from one another by a distance, each sidewall including a cross member joined with the upper rail proximate the scoop and the lower rail proximate the base, wherein the cross member, lower rail and upper rail cooperate to at least partially define a sidewall hole in the sidewall that reduces the weight of the head, wherein the cross member branches into a first secondary member defining a plurality of first laterally extending holes and branches into a second secondary member defining a plurality of second laterally extending holes, the first laterally extending holes aligned along a first contour on the cross member and the first secondary member, the second laterally extending holes aligned along a second contour on the cross member and the second secondary member, wherein the first laterally extending holes and the second laterally extending holes are adapted to receive a lacrosse net so that a user can string the lacrosse net to selected ones of the plurality of first laterally extending holes and the plurality of second laterally extending holes to provide the lacrosse net with a pocket profile and wherein the upper rail and lower rail join the scoop at a scoop junction, wherein at least one of the first laterally extending hole and the second laterally extending hole is defined in the scoop junction, wherein the cross member joins the lower rail at a rail junction, wherein in at least one of the first laterally extending hole and the second laterally extending hole is defined in the rail junction.

7. The lacrosse head of claim 6 wherein the first secondary member is joined with at least one of the upper rail, the lower rail, the base and the scoop.

8. The lacrosse head of claim 7 wherein the second secondary member is joined with at least one of the upper rail, the lower rail, the base and the scoop.

9. The lacrosse head of claim 6 wherein the first laterally extending holes and the second laterally extending holes are configured so that a lacrosse net strung to at least one of the first laterally extending holes and the second laterally extending holes forms a pocket that is at least partially suspended between the pair of sidewalls.

10. The lacrosse head of claim 6 wherein the cross member includes first and second ends, the first end joined with the upper rail, the second end joined with the lower rail.

11. The lacrosse head of claim 6 wherein the upper rail and the lower rail are substantially void of any string holes.

12. The lacrosse head of claim 6 wherein the base defines a plurality of base string holes and wherein the scoop defines a plurality of scoop string holes.

13. A lacrosse head comprising:

a throat adapted to connect to a lacrosse handle;

a base joined with the throat;

a scoop distal from the base; and a pair of sidewalls extending from the base and joined with one another distal from the base at the scoop, each sidewall being of an open frame construction, each sidewall including an upper rail and a lower rail separated from one another by a distance, each sidewall including a cross member joined with the upper rail proximate the scoop and the lower rail proximate the base, wherein the cross member branches into a first secondary member defining a first plurality of polygonal holes and branches into a second secondary member defining a second plurality of polygonal holes, wherein the first and second plurality of polygonal holes correspond to a plurality of pocket configurations, whereby a user can attach a lacrosse net to selected ones of the first and second plurality of polygonal holes and achieve a pocket profile and wherein the cross member joins the lower rail at a rail junction wherein at least one of the first and second plurality of polygonal holes is defined in the rail junction, wherein the upper rail and lower rail join the scoop at a scoop junction wherein at least one of the first and second plurality of polygonal holes is defined in the scoop junction.

14. The lacrosse head of claim 13 wherein the cross member includes a plurality of upper and lower secondary members extending from the upper and lower rails respectively, each upper and lower secondary member defining a secondary hole to which a net string can be attached.

15. The lacrosse head of claim 14 wherein the secondary holes of the upper secondary member are aligned along a first contour, and the secondary holes of the lower secondary member are aligned along a second contour.

16. The lacrosse head of claim 15 wherein the first contour and the second contour are substantially parallel.

17. The lacrosse head of claim 13 wherein the upper rail and the lower rail are substantially void of string holes.

18. The lacrosse head of claim 13 wherein the first and second plurality of polygonal holes are aligned on first and second contours respectively, the first and second contours being at least partially transverse to one another.

19. The lacrosse head of claim 13 wherein the head defines a longitudinal axis extending along the head, wherein each of the first and second plurality of polygonal holes extend from an exterior surface of the sidewall to an interior surface of the sidewall generally toward the longitudinal axis of the head.

20. The lacrosse head of claim 13 wherein the lower rail defines a plurality of string holes, whereby a user can string the lacrosse net to various ones of the plurality of the string holes and various ones of the plurality of polygonal holes to achieve a pocket profile.

21. A lacrosse head comprising:

a throat adapted to connect to a lacrosse handle;

a base joined with the throat;

a scoop distal from the base; and a pair of sidewalls extending from the base and joined with one another distal from the base at the scoop, each sidewall including a sidewall upper rail and a sidewall lower rail separated from one another by a distance, each sidewall including a plurality of X-shaped cross members adjacent one another, wherein each of the plurality of X-shaped cross members include tops joined with a cross member upper rail and bottoms joined with a cross member lower rail to define a plurality of polygonal holes corresponding to a plurality of pocket configurations, wherein the polygonal holes are adapted to receive a lacrosse net so that a user can string the lacrosse net to selected ones of the plurality of polygonal holes to provide the lacrosse net with a pocket profile.

22. The lacrosse head of claim 21 wherein the plurality of polygonal holes includes a plurality of first polygonal holes aligned along a first contour and a plurality of second polygonal holes aligned along a second contour downwardly displaced from said first contour.

23. The lacrosse head of claim 22 wherein the sidewall lower rail defines a plurality of string holes defined on a third contour downwardly displaced from first and second contours.

24. The lacrosse head of claim 21 wherein the sidewall lower rail is substantially void of any string holes.

25. The lacrosse head of claim 21 comprising a lacrosse net that is joined with the head to form a pocket that is at least partially suspended and located between the pair of sidewalls.

* * * * *